US009523137B2

(12) United States Patent
Marquardt et al.

(10) Patent No.: US 9,523,137 B2
(45) **Date of Patent: *Dec. 20, 2016**

(54) METASTABLE β-TITANIUM ALLOYS AND METHODS OF PROCESSING THE SAME BY DIRECT AGING

(71) Applicant: ATI PROPERTIES LLC, Albany, OR (US)

(72) Inventors: Brian Marquardt, Warsaw, IN (US); John Randolph Wood, Weddington, NC (US); Howard L. Freese, Charlotte, NC (US); Victor R. Jablokov, Charlotte, NC (US)

(73) Assignee: ATI PROPERTIES LLC, Albany, OR (US)

( * ) Notice: Subject to any disclaimer, the term of this patent is extended or adjusted under 35 U.S.C. 154(b) by 439 days.

This patent is subject to a terminal disclaimer.

(21) Appl. No.: 14/083,759

(22) Filed: Nov. 19, 2013

(65) Prior Publication Data

US 2014/0076468 A1 Mar. 20, 2014

Related U.S. Application Data

(60) Continuation of application No. 12/911,947, filed on Oct. 26, 2010, now Pat. No. 8,623,155, which is a division of application No. 11/057,614, filed on Feb. 14, 2005, now Pat. No. 7,837,812.

(60) Provisional application No. 60/573,180, filed on May 21, 2004.

(51) Int. Cl.
*C22F 1/18* (2006.01)
*C22C 14/00* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS

| | | | |
|---|---|---|---|
| 2,857,269 | A | 10/1958 | Vordahl |
| 2,932,886 | A | 4/1960 | Althouse |
| 2,974,076 | A | 3/1961 | Vordahl |
| 3,015,292 | A | 1/1962 | Bridwell |
| 3,025,905 | A | 3/1962 | Haerr |
| 3,060,564 | A | 10/1962 | Corral |
| 3,082,083 | A | 3/1963 | Levy et al. |
| 3,117,471 | A | 1/1964 | O'Connell et al. |
| 3,313,138 | A | 4/1967 | Spring et al. |
| 3,379,522 | A | 4/1968 | Vordahl |
| 3,489,617 | A | 1/1970 | Wuerfel |
| 3,584,487 | A | 6/1971 | Carlson |
| 3,605,477 | A | 9/1971 | Carlson |
| 3,615,378 | A | 10/1971 | Bomberger, Jr. et al. |
| 3,635,068 | A | 1/1972 | Watmough et al. |
| 3,649,259 | A | 3/1972 | Heitman |
| 3,676,225 | A | 7/1972 | Owczarski et al. |
| 3,686,041 | A | 8/1972 | Lee |
| 3,802,877 | A | 4/1974 | Parris et al. |
| 3,815,395 | A | 6/1974 | Sass |
| 3,835,282 | A | 9/1974 | Sass et al. |
| 3,922,899 | A | 12/1975 | Fremont et al. |
| 3,979,815 | A | 9/1976 | Nakanose et al. |
| 4,053,330 | A | 10/1977 | Henricks et al. |
| 4,067,734 | A | 1/1978 | Curtis et al. |
| 4,094,708 | A | 6/1978 | Hubbard et al. |
| 4,098,623 | A | 7/1978 | Ibaraki et al. |
| 4,120,187 | A | 10/1978 | Mullen |
| 4,138,141 | A | 2/1979 | Andersen |
| 4,147,639 | A | 4/1979 | Lee et al. |
| 4,150,279 | A | 4/1979 | Metcalfe et al. |
| 4,163,380 | A | 8/1979 | Masoner |
| 4,197,643 | A | 4/1980 | Burstone et al. |

(Continued)

FOREIGN PATENT DOCUMENTS

| | | | |
|---|---|---|---|
| CN | 1070230 | A | 3/1993 |
| CN | 1194671 | A | 9/1998 |

(Continued)

OTHER PUBLICATIONS

"Allvac TiOsteum and TiOstalloy Beat Titanium Alloys", printed from www.allvac.com/allvac/pages/Titanium/TiOsteum.htm on Nov. 7, 2005.

"Datasheet: Timetal 21S", Alloy Digest, Advanced Materials and Processes (9/98), pp. 38-39.

"Heat Treating of Nonferrous Alloys: Heat Treating of Titanium and Titanium Alloys," Metals Handbook, ASM Handbooks Online (2002).

(Continued)

*Primary Examiner* — Jessee Roe
(74) *Attorney, Agent, or Firm* — K&L Gates LLP

(57) ABSTRACT

Metastable beta titanium alloys and methods of processing metastable β-titanium alloys are disclosed. For example, certain non-limiting embodiments relate to metastable β-titanium alloys, such as binary β-titanium alloys comprising greater than 10 weight percent molybdenum, having tensile strengths of at least 150 ksi and elongations of at least 12 percent. Other non-limiting embodiments relate to methods of processing metastable β-titanium alloys, and more specifically, methods of processing binary β-titanium alloys comprising greater than 10 weight percent molybdenum, wherein the method comprises hot working and aging the metastable β-titanium alloy at a temperature below the β-transus temperature of the metastable β-titanium alloy for a time sufficient to form α-phase precipitates in the metastable β-titanium alloy. The metastable β-titanium alloys are not solution heat treated after hot working and prior to aging. Articles of manufacture comprising binary β-titanium alloys according to various non-limiting embodiments disclosed herein are also disclosed.

26 Claims, 2 Drawing Sheets

(56) References Cited

U.S. PATENT DOCUMENTS 4,229,216 A 10/1980 Paton et al.
4,309,226 A 1/1982 Chen
4,472,207 A 9/1984 Kinoshita et al.
4,482,398 A 11/1984 Eylon et al.
4,510,788 A 4/1985 Ferguson et al.
4,543,132 A 9/1985 Berczik et al.
4,614,550 A 9/1986 Leonard et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,799,975 A 1/1989 Ouchi et al.
4,808,249 A 2/1989 Eylon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship et al.
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Ishii et al.
6,823,705 B2 11/2004 Fukuda et al.
6,908,517 B2 6/2005 Segal et al.
6,918,971 B2 7/2005 Fujii et al.
6,932,877 B2 8/2005 Raymond et al.
6,971,256 B2 12/2005 Okada et al.
7,008,491 B2 3/2006 Woodfield
7,010,950 B2 3/2006 Cai et al.
7,032,426 B2 4/2006 Durney et al.
7,037,389 B2 5/2006 Barbier et al.
7,038,426 B2 5/2006 Hill
7,096,596 B2 8/2006 Hernandez, Jr. et al.
7,132,021 B2 11/2006 Kuroda et al.
7,152,449 B2 12/2006 Durney et al.
7,264,682 B2 9/2007 Chandran
7,269,986 B2 9/2007 Pfaffmann et al.
7,332,043 B2 2/2008 Tetyukhin et al.
7,410,610 B2 8/2008 Woodfield et al.
7,438,849 B2 10/2008 Kuramoto et al.
7,449,075 B2 11/2008 Woodfield et al.
7,536,892 B2 5/2009 Amino et al.
7,559,221 B2 7/2009 Horita et al.
7,601,232 B2 10/2009 Fonte
7,611,592 B2 11/2009 Davis et al.
7,708,841 B2 5/2010 Saller et al.
7,837,812 B2 11/2010 Marquardt et al.
7,879,286 B2 2/2011 Miracle et al.
7,947,136 B2 5/2011 Saller
7,984,635 B2 7/2011 Callebaut et al.
8,037,730 B2 10/2011 Polen et al.

(56) References Cited

U.S. PATENT DOCUMENTS

| | | | |
|---|---|---|---|
| 8,048,240 | B2 | 11/2011 | Hebda et al. |
| 8,128,764 | B2 | 3/2012 | Miracle et al. |
| 8,211,548 | B2 | 7/2012 | Chun et al. |
| 8,316,687 | B2 | 11/2012 | Slattery |
| 8,336,359 | B2 | 12/2012 | Werz |
| 8,408,039 | B2 | 4/2013 | Cao et al. |
| 8,454,765 | B2 | 6/2013 | Saller et al. |
| 8,499,605 | B2 | 8/2013 | Bryan |
| 8,568,540 | B2 | 10/2013 | Marquardt et al. |
| 8,578,748 | B2 | 11/2013 | Huskamp et al. |
| 8,597,442 | B2 | 12/2013 | Hebda et al. |
| 8,597,443 | B2 | 12/2013 | Hebda et al. |
| 8,608,913 | B2 | 12/2013 | Shim et al. |
| 8,679,269 | B2 | 3/2014 | Goller et al. |
| 9,034,247 | B2 | 5/2015 | Suzuki et al. |
| 9,192,981 | B2 | 11/2015 | Forbes Jones et al. |
| 9,206,497 | B2 | 12/2015 | Bryan et al. |
| 9,255,316 | B2 | 2/2016 | Bryan |
| 2003/0168138 | A1 | 9/2003 | Marquardt |
| 2004/0099350 | A1 | 5/2004 | Manitone et al. |
| 2004/0148997 | A1 | 8/2004 | Amino et al. |
| 2004/0221929 | A1 | 11/2004 | Hebda et al. |
| 2004/0250932 | A1 | 12/2004 | Briggs |
| 2005/0145310 | A1 | 7/2005 | Bewlay et al. |
| 2006/0045789 | A1 | 3/2006 | Nasserrafi et al. |
| 2006/0110614 | A1 | 5/2006 | Liimatainen |
| 2006/0243356 | A1 | 11/2006 | Oikawa et al. |
| 2007/0017273 | A1 | 1/2007 | Haug et al. |
| 2007/0193662 | A1 | 8/2007 | Jablokov et al. |
| 2007/0286761 | A1 | 12/2007 | Miracle et al. |
| 2008/0000554 | A1 | 1/2008 | Yaguchi et al. |
| 2008/0103543 | A1 | 5/2008 | Li et al. |
| 2008/0107559 | A1 | 5/2008 | Nishiyama et al. |
| 2008/0202189 | A1 | 8/2008 | Otaki |
| 2008/0210345 | A1 | 9/2008 | Tetyukhin et al. |
| 2008/0264932 | A1 | 10/2008 | Hirota |
| 2009/0000706 | A1 | 1/2009 | Huron et al. |
| 2009/0183804 | A1 | 7/2009 | Zhao et al. |
| 2009/0234385 | A1 | 9/2009 | Cichocki et al. |
| 2011/0038751 | A1 | 2/2011 | Marquardt et al. |
| 2011/0180188 | A1 | 7/2011 | Bryan et al. |
| 2012/0012233 | A1 | 1/2012 | Bryan |
| 2012/0060981 | A1 | 3/2012 | Forbes Jones et al. |
| 2012/0067100 | A1 | 3/2012 | Stefansson et al. |
| 2012/0076611 | A1 | 3/2012 | Bryan |
| 2012/0076612 | A1 | 3/2012 | Bryan |
| 2012/0076686 | A1 | 3/2012 | Bryan |
| 2012/0279351 | A1 | 11/2012 | Gu et al. |
| 2012/0308428 | A1 | 12/2012 | Forbes Jones et al. |
| 2013/0062003 | A1 | 3/2013 | Shulkin et al. |
| 2013/0118653 | A1 | 5/2013 | Bryan et al. |
| 2013/0156628 | A1 | 6/2013 | Forbes Jones et al. |
| 2013/0291616 | A1 | 11/2013 | Bryan |
| 2014/0060138 | A1 | 3/2014 | Hebda et al. |
| 2014/0076471 | A1 | 3/2014 | Forbes Jones et al. |
| 2014/0116582 | A1 | 5/2014 | Forbes Jones et al. |
| 2014/0238552 | A1 | 8/2014 | Forbes Jones et al. |
| 2014/0255719 | A1 | 9/2014 | Forbes Jones et al. |
| 2014/0260492 | A1 | 9/2014 | Thomas et al. |
| 2014/0261922 | A1 | 9/2014 | Thomas et al. |
| 2015/0129093 | A1 | 5/2015 | Forbes Jones et al. |
| 2016/0047024 | A1 | 2/2016 | Bryan |
| 2016/0122851 | A1 | 5/2016 | Jones et al. |
| 2016/0138149 | A1 | 5/2016 | Bryan |
| 2016/0201165 | A1 | 7/2016 | Foltz, IV |

FOREIGN PATENT DOCUMENTS

| | | | |
|---|---|---|---|
| CN | 1403622 | | 3/2003 |
| CN | 1816641 | A | 8/2006 |
| CN | 101104898 | A | 1/2008 |
| CN | 101205593 | A | 6/2008 |
| CN | 101294264 | A | 10/2008 |
| CN | 101684530 | A | 3/2010 |
| CN | 101637789 | B | 6/2011 |
| CN | 102212716 | A | 10/2011 |
| CN | 102816953 | A | 12/2012 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1471158 | A1 | 10/2004 |
| EP | 1605073 | A1 | 12/2005 |
| EP | 1612289 | A2 | 1/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| FR | 2545104 | A1 | 11/1984 |
| GB | 847103 | | 9/1960 |
| GB | 1170997 | A | 11/1969 |
| GB | 1433306 | | 4/1976 |
| GB | 2151260 | A | 7/1985 |
| GB | 2337762 | A | 12/1999 |
| JP | 55-113865 | A | 9/1980 |
| JP | 57-62820 | A | 4/1982 |
| JP | 57-62846 | A | 4/1982 |
| JP | 60-046358 | | 3/1985 |
| JP | 60-100655 | A | 6/1985 |
| JP | S61-217564 | A | 9/1986 |
| JP | 62-109956 | A | 5/1987 |
| JP | 62-127074 | A | 6/1987 |
| JP | 62-149859 | A | 7/1987 |
| JP | S63-47302 | A | 3/1988 |
| JP | S63-188426 | A | 8/1988 |
| JP | 1-279736 | A | 11/1989 |
| JP | 2-205661 | A | 8/1990 |
| JP | 3-134124 | A | 6/1991 |
| JP | H03-264618 | A | 11/1991 |
| JP | 4-74856 | A | 3/1992 |
| JP | 4-103737 | A | 4/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | H05-293555 | A | 11/1993 |
| JP | 8-300044 | A | 11/1996 |
| JP | 9-143650 | | 6/1997 |
| JP | 9-194969 | A | 7/1997 |
| JP | 9-215786 | A | 8/1997 |
| JP | H10-128459 | A | 5/1998 |
| JP | H10-306335 | A | 11/1998 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-146497 | A | 5/2002 |
| JP | 2003-55749 | A | 2/2003 |
| JP | 2003-74566 | A | 3/2003 |
| JP | 2003-285126 | A | 10/2003 |
| JP | 2003-334633 | A | 11/2003 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| KR | 920004946 | | 6/1992 |

(56) References Cited

FOREIGN PATENT DOCUMENTS

| | | | |
|---|---|---|---|
| KR | 10-2005-0087765 | A | 8/2005 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2269584 | C1 | 2/2006 |
| RU | 2364660 | C1 | 8/2009 |
| RU | 2368695 | C1 | 9/2009 |
| RU | 2393936 | C1 | 7/2010 |
| SU | 534518 | A1 | 1/1977 |
| SU | 631234 | A | 11/1978 |
| SU | 1088397 | A1 | 2/1991 |
| UA | 38805 | A | 5/2001 |
| UA | 40862 | A | 8/2001 |
| UA | a200613448 | | 6/2008 |
| WO | WO 98/17386 | A1 | 4/1998 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2007/084178 | A2 | 7/2007 |
| WO | WO 2007/114439 | A1 | 10/2007 |
| WO | WO 2008/017257 | A1 | 2/2008 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

"Stryker Orthopaedics TMZF® Alloy (UNS R58120)", printed from www.allvac.com/allvac/pages/Titanium/UNSR58120.htm on Nov. 7, 2005.

"Technical Data Sheet: Allvac® Ti—15Mo Beta Titanium Alloy" (dated Jun. 16, 2004).

"ASTM Designation F1801-97 Standard Practice for Corrosion Fatigue Testing of Metallic Implant Materials" ASTM International (1997) pp. 876-880.

"ASTM Designation F2066-01 Standard Specification for Wrought Titanium-15 Molybdenum Alloy for Surgical Implant Applications (UNS R58150)," ASTM International (2000) pp. 1-4.

AL-6XN® Alloy (UNS N08367) Allegheny Ludlum Corporation, 2002, 56 pages.

Allegheny Ludlum, "High Performance Metals for Industry, High Strength, High Temperature, and Corrosion-Resistant Alloys", (2000) pp. 1-8.

Allvac, Product Specification for "Allvac Ti-15 Mo," available at http://www.allvac.com/allvac/pages/Titanium/Ti15MO.htm, last visited Jun. 9, 2003 p. 1 of 1.

Altemp® A286 Iron-Base Superalloy (UNS Designation S66286) Allegheny Ludlum Technical Data Sheet Blue Sheet, 1998, 8 pages.

ASM Materials Engineering Dictionary, J.R. Davis Ed., ASM International, Materials Park, OH (1992) p. 39.

ATI Datalloy 2 Alloy, Technical Data Sheet, ATI Allvac, Monroe, NC, SS-844, Version1, Sep. 17, 2010, 8 pages.

ATI 690 (UNS N06690) Nickel-Base, ATI Allvac, Oct. 5, 2010, 1 page.

Isothermal forging definition, ASM Materials Engineering Dictionary, J.R. Davis ed., Fifth Printing, Jan. 2006, ASM International, p. 238.

Isothermal forging, printed from http://thelibraryofmanufacturing.com/isothermal_forging.html, accessed Jun. 5, 2013, 3 pages.

Adiabatic definition, ASM Materials Engineering Dictionary, J.R. Davis ed., Fifth Printing, Jan. 2006, ASM International, p. 9.

Adiabatic process—Wikipedia, the free encyclopedia, printed from http://en.wikipedia.org/wiki/Adiabatic_process, accessed May 21, 2013, 10 pages.

ASTM Designation F 2066-01, "Standard Specification for Wrought Titanium-15 Molybdenum Alloy for Surgical Implant Applications (UNS R58150)", May 2001, 7 pages.

ASTM Designation F 2066/F2066M-13, "Standard Specification for Wrought Titanium-15 Molybdenum Alloy for Surgical Implant Applications (UNS R58150)", Nov. 2013, 6 pages.

ATI 6-2-4-2™ Alloy Technical Data Sheet, Version 1, Feb. 26, 2012, 4 pages.

ATI 6-2-4-6™ Titanium Alloy Data Sheet, accessed Jun. 26, 2012.

ATI 425, High-Strength Titanium Alloy, Alloy Digest, ASM International, Jul. 2004, 2 pages.

ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.

ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.

ATI 425®-MIL Alloy, Technical Data Sheet, Version 1, May 28, 2010, pp. 1-5.

ATI 425®-MIL Alloy, Technical Data Sheet, Version 2, Aug. 16, 2010, 5 pages.

ATI 425®-MIL Titanium Alloy, Mission Critical Metallics®, Version 3, Sep. 10, 2009, pp. 1-4.

ATI 425® Titanium Alloy, Grade 38 Technical Data Sheet, Version 1, Feb. 1, 2012, pp. 1-6.

ATI 500-MIL™, Mission Critical Metallics®, High Hard Specialty Steel Armor, Version 4, Sep. 10, 2009, pp. 1-4.

ATI 600-MIL®, Preliminary Draft Data Sheet, Ultra High Hard Specialty Steel Armor, Version 4, Aug. 10, 2010, pp. 1-3.

ATI 600-MIL™, Preliminary Draft Data Sheet, Ultra High Hard Specialty Steel Armor, Version 3, Sep. 10, 2009, pp. 1-3.

ATI Aerospace Materials Development, Mission Critical Metallics, Apr. 30, 2008, 17 pages.

ATI Ti—15Mo Beta Titanium Alloy Technical Data Sheet, ATI Allvac, Monroe, NC, Mar. 21, 2008, 3 pages.

ATI Titanium 6Al—2Sn—4Zr—2Mo Alloy, Technical Data Sheet, Version 1, Sep. 17, 2010, pp. 1-3.

ATI Titanium 6Al—4V Alloy, Mission Critical Metallics®, Technical Data Sheet, Version 1, Apr. 22, 2010, pp. 1-3.

ATI Wah Chang, ATI™ 425 Titanium Alloy (Ti—4Al—2.5V—1.5Fe—0.2502), Technical Data Sheet, 2004, pp. 1-5.

ATI Wah Chang, Titanium and Titanium Alloys, Technical Data Sheet, 2003, pp. 1-16.

Beal et al., "Forming of Titanium and Titanium Alloys—Cold Forming", ASM Handbook, 2006, ASM International, vol. 14B, 2 pages.

Bewlay, et al., "Superplastic roll forming of Ti alloys", Materials and Design, 21, 2000, pp. 287-295.

Bowen, A. W., "Omega Phase Embrittlement in Aged Ti-15%Mo," Scripta Metallurgica, vol. 5, No. 8 (1971) pp. 709-715.

Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.

Boyer, Rodney R., "Introduction and Overview of Titanium and Titanium Alloys: Applications," Metals Handbook, ASM Handbooks Online (2002).

Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.

Callister, Jr., William D., Materials Science and Engineering, an Introduction, Sixth Edition, John Wiley & Sons, pp. 180-184 (2003).

Desrayaud et al., "A novel high straining process for bulk materials—The development of a multipass forging system by compression along three axes", Journal of Materials Processing Technology, 172, 2006, pp. 152-158.

DiDomizio, et al., "Evaluation of a Ni—20Cr Alloy Processed by Multi-axis Forging", Materials Science Forum Vols. 503-504, 2006, pp. 793-798.

(56) References Cited

OTHER PUBLICATIONS

Disegi, J. A., "Titanium Alloys for Fracture Fixation Implants," Injury International Journal of the Care of the Injured, vol. 31 (2000) pp. S-D14-17.
Disegi, John, Wrought Titanium-15% Molybdenum Implant Material, Original Instruments and Implants of the Association for the Study of International Fixation—AO ASIF, Oct. (2003).
Donachie Jr., M.J., "Titanium A Technical Guide" 1988, ASM, pp. 39 and 46-50.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys-Solution Treating and Aging", ASM Handbook, 1991, ASM International, vol. 4, pp. 1-8.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", WEAR, 249(1-2), Jan. 17, 2001, 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications," Journal of ASTM International, vol. 2, Issue 9 (Oct. 2005) (published online Aug. 17, 2005).
Marquardt, Brian, "Characterization of Ti—15Mo for Orthopaedic Applications," TMS 2005 Annual Meeting: Technical Program, San Francisco, CA, Feb. 13-17, 2005 Abstract, p. 239.
Marquardt, Brian, "Ti-15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marte et al., "Structure and Properties of Ni—20CR Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti—15Mo Alloy," Titanium '80 Science and Technology—Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Nutt, Michael J. et al., "The Application of Ti-15 Beta Titanium Alloy in High Strength Structural Orthopaedic Applications," Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for 13 Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti—15Mo," Titanium '80 Science and Technology—Proceedings of the 4th International Conference on Titanium, H. Kimura & O. Izumi Eds. May 19-22, 1980 pp. 1344-1350.
Prasad, Y.V.R.K. et al. "Hot Deformation Mechanism in Ti—6Al—4V with Transformed B Starting Microstructure: Commercial v.

(56) References Cited

OTHER PUBLICATIONS

Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti—6A1—4V ELI, Ti—6A1—7 Nb, and Ti-15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium-6Aluminum-4Vanadium Alloy for Surgical Implant Applications (UNS R56400), Designation: F 1472-99, ASTM 1999, pp. 1-4.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V-xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
TIMET 6-6-2 Titanium Alloy (Ti—6Al—6V—2Sn), Annealed, accessed Jun. 27, 2012.
TIMET TIMETAL® 6-2-4-2 (Ti—6Al—2Sn—4Zr—2Mo—0.08Si) Titanium Alloy datasheet, accessed Jun. 26, 2012.
TIMET TIMETAL® 6-2-4-6 Titanium Alloy (Ti—6Al—2Sn—4Zr—6Mo), Typical, accessed Jun. 26, 2012.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Two new α-βtitanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.

(56) References Cited

OTHER PUBLICATIONS

ATI 600™ Technical Data Sheet, Nickel-base Alloy (UNS N06600), 2012 Allegheny Technologies Incorporated, Version 1, Mar. 19, 2012, 5 pages.
Office Action mailed Oct. 19, 2011 in U.S. Appl. No. 12/691,952.
Office Action mailed Feb. 2, 2012 in U.S. Appl. No. 12/691,952.
Office Action mailed Feb. 20, 2004 in U.S. Appl. No. 10/165,348.
Office Action mailed Oct. 26, 2004 in U.S. Appl. No. 10/165,348.
Office Action mailed Feb. 16, 2005 in U.S. Appl. No. 10/165,348.
Office Action mailed Jul. 25, 2005 in U.S. Appl. No. 10/165,348.
Office Action mailed Jan. 3, 2006 in U.S. Appl. No. 10/165,348.
Office Action mailed Dec. 16, 2004 in U.S. Appl. No. 10/434,598.
Office Action mailed Aug. 17, 2005 in U.S. Appl. No. 10/434,598.
Office Action mailed Dec. 19, 2005 in U.S. Appl. No. 10/434,598.
Office Action mailed Sep. 6, 2006 in U.S. Appl. No. 10/434,598.
Office Action mailed Aug. 6, 2008 in U.S. Appl. No. 11/448,160.
Office Action mailed Jan. 13, 2009 in U.S. Appl. No. 11/448,160.
Notice of Allowance mailed Apr. 13, 2010 in U.S. Appl. No. 11/448,160.
Notice of Allowance mailed Sep. 20, 2010 in U.S. Appl. No. 11/448,160.
Office Action mailed Sep. 26, 2007 in U.S. Appl. No. 11/057,614.
Office Action mailed Jan. 10, 2008 in U.S. Appl. No. 11/057,614.
Office Action mailed Aug. 29, 2008 in U.S. Appl. No. 11/057,614.
Office Action mailed Aug. 11, 2009 in U.S. Appl. No. 11/057,614.
Office Action mailed Jan. 14, 2010 in U.S. Appl. No. 11/057,614.
Interview summary mailed Apr. 14, 2010 in U.S. Appl. No. 11/057,614.
Office Action mailed Jun. 21, 2010 in U.S. Appl. No. 11/057,614.
Notice of Allowance mailed Sep. 3, 2010 in U.S. Appl. No. 11/057,614.
Office Action mailed Apr. 1, 2010 in U.S. Appl. No. 11/745,189.
Interview summary mailed Jun. 3, 2010 in U.S. Appl. No. 11/745,189.
Interview summary mailed Jun. 15, 2010 in U.S. Appl. No. 11/745,189.
Office Action mailed Nov. 24, 2010 in U.S. Appl. No. 11/745,189.
Interview summary mailed Jan. 6, 2011 in U.S. Appl. No. 11/745,189.
Notice of Allowance mailed Jun. 27, 2011 in U.S. Appl. No. 11/745,189.
Office Action mailed Jan. 11, 2011 in U.S. Appl. No. 12/911,947.
Office Action mailed Aug. 4, 2011 in U.S. Appl. No. 12/911,947.
Office Action mailed Nov. 16, 2011 in U.S. Appl. No. 12/911,947.
Advisory Action mailed Jan. 25, 2012 in U.S. Appl. No. 12/911,947.
Notice of Panel Decision from Pre-Appeal Brief Review mailed Mar. 28, 2012 in U.S. Appl. No. 12/911,947.
Office Action mailed Apr. 5, 2012 in U.S. Appl. No. 12/911,947.
Office Action mailed Sep. 19, 2012 in U.S. Appl. No. 12/911,947.
Advisory Action mailed Nov. 29, 2012 in U.S. Appl. No. 12/911,947.
Office Action mailed May 31, 2013 in U.S. Appl. No. 12/911,947.
Notice of Allowance mailed Oct. 4, 2013 in U.S. Appl. No. 12/911,947.
Office Action mailed Jan. 3, 2011 in U.S. Appl. No. 12/857,789.
Office Action mailed Jul. 27, 2011 in U.S. Appl. No. 12/857,789.
Advisory Action mailed Oct. 7, 2011 in U.S. Appl. No. 12/857,789.
Notice of Allowance mailed Jul. 1, 2013 in U.S. Appl. No. 12/857,789.
Office Action mailed Nov. 14, 2012 in U.S. Appl. No. 12/885,620.
Office Action mailed Jun. 13, 2013 in U.S. Appl. No. 12/885,620.
Office Action mailed Nov. 19, 2013 in U.S. Appl. No. 12/885,620.
Office Action mailed Nov. 14, 2012 in U.S. Appl. No. 12/888,699.
Office Action mailed Oct. 3, 2012 in U.S. Appl. No. 12/838,674.
Office Action mailed Jul. 18, 2013 in U.S. Appl. No. 12/838,674.
Office Action mailed Sep. 26, 2012 in U.S. Appl. No. 12/845,122.
Notice of Allowance mailed Apr. 17, 2013 in U.S. Appl. No. 12/845,122.
Office Action mailed Dec. 24, 2012 in U.S. Appl. No. 13/230,046.
Notice of Allowance mailed Jul. 31, 2013 in U.S. Appl. No. 13/230,046.
Office Action mailed Dec. 26, 2012 in U.S. Appl. No. 13/230,143.
Notice of Allowance mailed Aug. 2, 2013 in U.S. Appl. No. 13/230,143.
Office Action mailed Mar. 1, 2013 in U.S. Appl. No. 12/903,851.
Office Action mailed Mar. 25, 2013 in U.S. Appl. No. 13/108,045.
Office Action mailed Apr. 16, 2013 in U.S. Appl. No. 13/150,494.
Office Action mailed Jun. 14, 2013 in U.S. Appl. No. 13/150,494.
Notice of Allowance mailed Nov. 5, 2013 in U.S. Appl. No. 13/150,494.
U.S. Appl. No. 13/777,066, filed Feb. 26, 2013.
U.S. Appl. No. 13/331,135, filed Dec. 20, 2011.
U.S. Appl. No. 13/792,285, filed Mar. 11, 2013.
U.S. Appl. No. 13/844,196, filed Mar. 15, 2013.
U.S. Appl. No. 13/844,545 filed Mar. 15, 2013.
Office Action mailed Jan. 23, 2013 in U.S. Appl. No. 12/882,538.
Office Action mailed Feb. 8, 2013 in U.S. Appl. No. 12/882,538.
Notice of Allowance mailed Jun. 24, 2013 in U.S. Appl. No. 12/882,538.
U.S. Appl. No. 13/933,222, filed Mar. 15, 2013.
Office Action mailed Sep. 6, 2013 in U.S. Appl. No. 13/933,222.
Notice of Allowance mailed Oct. 1, 2013 in U.S. Appl. No. 13/933,222.
U.S. Appl. No. 14/077,699, filed Nov. 12, 2013.
U.S. Appl. No. 14/073,029, filed Nov. 6, 2013.
U.S. Appl. No. 14/093,707, filed Dec. 2, 2013.
Beal et al., "Forming of Titanium and Titanium Alloys—Cold Forming", ASM Handbook, 2006, ASM International, Revised by ASM Committee on Forming Titanium Alloys, vol. 14B, 2 pages.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
Office Action mailed Dec. 23, 2014 in U.S. Appl. No. 12/691,952.
Office Action mailed Nov. 28, 2014 in U.S. Appl. No. 12/885,620.
Office Action mailed Oct. 6, 2014 in U.S. Appl. No. 12/903,851.
Office Action mailed Jan. 21, 2015 in U.S. Appl. No. 13/792,285.
Notice of Allowance mailed Oct. 24, 2014 in U.S. Appl. No. 13/844,545.
Notice of Allowance mailed Feb. 6, 2015 in U.S. Appl. No. 13/844,545.
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Advisory Action Before the Filing of an Appeal Brief mailed Jan. 30, 2014 in U.S. Appl. No. 12/885,620.
Office Action mailed Jun. 18, 2014 in U.S. Appl. No. 12/885,620.
Office Action mailed Jan. 16, 2014 in U.S. Appl. No. 12/903,851.
Office Action mailed Jan. 17, 2014 in U.S. Appl. No. 13/108,045.
Supplemental Notice of Allowability mailed Jan. 17, 2014 in U.S. Appl. No. 13/150,494.
Notice of Allowance mailed May 6, 2014 in U.S. Appl. No. 13/933,222.
ASM Materials Engineering Dictionary, "Blasting or Blast Cleaning," J.R. Davis Ed., ASM International, Materials Park, OH (1992) p. 42.
Beal et al., "Forming of Titanium and Titanium Alloys—Cold Forming", ASM Handbook, 2006, vol. 14B, pp. 656-669.
Craighead et al., "Ternary Alloys of Titanium", Journal of Metals, Mar. 1950, Transactions AIME, vol. 188, pp. 514-538.

(56) References Cited

OTHER PUBLICATIONS

Craighead et al., "Titanium Binary Alloys", Journal of Metals, Mar. 1950, Transactions AIME, vol. 188, pp. 485-513.
Diderrich et al., "Addition of Cobalt to the Ti—6Al—4V Alloy", Journal of Metals, May 1968, pp. 29-37.
Donachie Jr., M.J., "Heat Treating Titanium and Its Alloys", Heat Treating Process, Jun./Jul. 2001, pp. 47-49, 52-53, and 56-57.
Glazunov et al., Structural Titanium Alloys, Moscow, Metallurgy, 1974, pp. 264-283.
Swann, P.R. and J. G. Parr, "Phase Transformations in Titanium-Rich Alloys of Titanium and Cobalt", Transactions of The Metallurgical Society of AIME, Apr. 1958, pp. 276-279.
Yakymyshyn et al., "The Relationship between the Constitution and Mechanical Properties of Titanium-Rich Alloys of Titanium and Cobalt", 1961, vol. 53, pp. 283-294.
AFML-TR-76-80 Development of Titanium Alloy Casting Technology, Aug. 1976, 5 pages.
Valiev et al., "Nanostructured materials produced by sever plastic deformation", Moscow, LOGOS, 2000.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
French, D., "Austenitic Stainless Steel", The National Board of Boiler and Pressure Vessel Inspectors Bulletin, 1992, 3 pages.
Titanium Alloy Guide, RMI Titanium Company, Jan. 2000, 45 pages.
Wanhill et al, "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Gammon et al., "Metallography and Microstructures of Titanium and Its Alloys", ASM Handbook, vol. 9: Metallography and Microstructures, ASM International, 2004, pp. 899-917.
Applicant-Initiated Interview Summary mailed Aug. 22, 2016 in U.S. Appl. No. 12/691,952.
Advisory Action Before the Filing of an Appeal Brief mailed Aug. 30, 2016 in U.S. Appl. No. 12/691,952.
Advisory Action mailed May 18, 2015 in U.S. Appl. No. 12/885,620.
Office Action mailed Jun. 30, 2015 in U.S. Appl. No. 12/885,620.
Notice of Abandonment mailed Jan. 29, 2016 in U.S. Appl. No. 12/885,620.
Office Action mailed May 27, 2015 in U.S. Appl. No. 12/838,674.
Applicant Initiated Interview Summary mailed Sep. 1, 2015 in U.S. Appl. No. 12/838,674.
Notice of Allowance mailed Sep. 25, 2015 in U.S. Appl. No. 12/838,674.
Office Action mailed Jul. 15, 2015 in U.S. Appl. No. 12/903,851.
Office Action mailed Mar. 30, 2016 in U.S. Appl. No. 13/108,045.
Office Action mailed Sep. 9, 2016 in U.S. Appl. No. 13/108,045.
Office Action mailed Jun. 4, 2015 in U.S. Appl. No. 13/792,285.
Notice of Allowance mailed Sep. 16, 2015 in U.S. Appl. No. 13/792,285.
Response to Rule 312 Communication mailed Oct. 20, 2015 in U.S. Appl. No. 13/792,285.
Office Action mailed Jun. 3, 2015 in U.S. Appl. No. 13/714,465.
Office Action mailed Jul. 8, 2015 in U.S. Appl. No. 13/714,465.
Notice of Allowance mailed Sep. 2, 2015 in U.S. Appl. No. 13/714,465.
Response to Rule 312 Communication mailed Sep. 29, 2015 in U.S. Appl. No. 13/714,465.
Response to Rule 312 Communication mailed Oct. 8, 2015 in U.S. Appl. No. 13/714,465.
Office Action mailed Oct. 5, 2015 in U.S. Appl. No. 13/777,066.
Advisory Action Before the Filing of an Appeal Brief mailed Mar. 17, 2016 in U.S. Appl. No. 13/777,066.
Office Action mailed Jul. 22, 2016 in U.S. Appl. No. 13/777,066.
Office Action mailed Aug. 19, 2015 in U.S. Appl. No. 13/844,196.
Office Action mailed Oct. 15, 2015 in U.S. Appl. No. 13/844,196.
Office Action mailed Feb. 12, 2016 in U.S. Appl. No. 13/844,196.
Advisory Action Before the Filing of an Appeal Brief mailed Jun. 15, 2016 in U.S. Appl. No. 13/844,196.
Office Action mailed Aug. 22, 2016 in U.S. Appl. No. 13/844,196.
Office Action mailed Oct. 2, 2015 in U.S. Appl. No. 14/073,029.
Office Action mailed Aug. 12, 2016 in U.S. Appl. No. 14/073,029.
Office Action mailed Oct. 28, 2015 in U.S. Appl. No. 14/093,707.
Office Action mailed Mar. 17, 2016 in U.S. Appl. No. 14/093,707.
Advisory Action Before the Filing of an Appeal Brief mailed Jun. 10, 2016 in U.S. Appl. No. 14/093,707.
Office Action mailed Jul. 25, 2016 in U.S. Appl. No. 14/077,699.
Office Action mailed Aug. 16, 2016 in U.S. Appl. No. 14/077,699.
Office Action mailed Mar. 16, 2016 in U.S. Appl. No. 15/005,281.
Office Action mailed Aug. 26, 2016 in U.S. Appl. No. 15/005,281.
U.S. Appl. No. 14/948,941, filed Nov. 23, 2015.
Office Action mailed Apr. 5, 2016 in U.S. Appl. No. 14/028,588.
Office Action mailed Aug. 8, 2016 in U.S. Appl. No. 14/028,588.
Office Action mailed Jun. 26, 2015 in U.S. Appl. No. 13/777,066.
Notice of Third-Party Submission mailed Dec. 16, 2015 in U.S. Appl. No. 14/077,699.

METASTABLE β-TITANIUM ALLOYS AND METHODS OF PROCESSING THE SAME BY DIRECT AGING

CROSS-REFERENCE TO RELATED APPLICATIONS

This application claims priority under 35 U.S.C. §120 as a continuation of U.S. patent application Ser. No. 12/911,947, now U.S. Pat. No. 8,623,155, filed Oct. 26, 2010, which in turn claims priority under 35 U.S.C. §120 as a divisional application of U.S. patent application Ser. No. 11/057,614, filed Feb. 14, 2005, now U.S. Pat. No. 7,837,812, which in turn claims the benefit of Provisional Application No. 60/573,180, filed on May 21, 2004. The entire disclosures of U.S. patent application Ser. No. 12/911,947, U.S. Pat. No. 7,837,812, and U.S. Provisional Patent Application Ser. No. 60/573,180 are hereby incorporated by reference herein.

BACKGROUND

The present disclosure generally relates to metastable β-titanium alloys and methods of processing metastable β-titanium alloys. More specifically, certain embodiments of the present invention relate to binary metastable β-titanium alloys comprising greater than 10 weight percent molybdenum, and methods of processing such alloys by hot working and direct aging. Articles of manufacture made from the metastable β-titanium alloys disclosed herein are also provided.

Metastable beta-titanium (or "β-titanium") alloys generally have a desirable combination of ductility and biocompatibility that makes them particularly well suited for use in certain biomedical implant applications requiring custom fitting or contouring by the surgeon in an operating room. For example, solution treated (or "β-annealed") metastable β-titanium alloys that comprise a single-phase beta microstructure, such as binary β-titanium alloys comprising about 15 weight percent molybdenum ("Ti-15Mo"), have been successfully used in fracture fixation applications and have been found to have an ease of use approaching that of stainless steel commonly used in such applications. However, because the strength of solution treated Ti-15Mo alloys is relatively low, they are generally not well suited for use in applications requiring higher strength alloys, for example, hip joint prostheses. For example, conventional Ti-15Mo alloys that have been solution treated at a temperature near or above the β-transus temperature and subsequently cooled to room temperature without further aging, typically have an elongation of about 25 percent and a tensile strength of about 110 ksi. As used herein the terms "β-transus temperature," or "β-transus," refer to the minimum temperature above which equilibrium α-phase (or "alpha-phase") does not exist in the titanium alloy. See e.g., *ASM Materials Engineering Dictionary*, J. R. Davis Ed., ASM International, Materials Park, Ohio (1992) at page 39, which is specifically incorporated by reference herein.

Although the tensile strength of a solution treated Ti-15Mo alloy can be increased by aging the alloy to precipitate α-phase (or alpha phase) within the β-phase microstructure, typically aging a solution treated Ti-15Mo alloy results in a dramatic decrease in the ductility of the alloy. For example, although not limiting herein, if a Ti-15Mo alloy is solution treated at about 1472° F. (800° C.), rapidly cooled, and subsequently aged at a temperature ranging from 887° F. (475° C.) to 1337° F. (725° C.), an ultimate tensile strength ranging from about 150 ksi to about 200 ksi can be achieved. However, after aging as described, the alloy can have a percent elongation around 11% (for the 150 ksi material) to around 5% (for the 200 ksi material). See John Disegi, "AO ASIF Wrought Titanium-15% Molybdenum Implant Material," *AO ASIF Materials Expert Group, 1st Ed.*, (October 2003), which is specifically incorporated by reference herein. In this condition, the range of applications for which the Ti-15Mo alloy is suited can be limited due to the relatively low ductility of the alloy.

Further, since metastable β-titanium alloys tend to deform by twinning, rather than by the formation and movement of dislocations, these alloys generally cannot be strengthened to any significant degree by cold working (i.e., work hardening) alone.

Accordingly, there is a need for metastable β-titanium alloys, such as binary β-titanium alloys comprising greater than 10 weight percent molybdenum, having both good tensile properties (e.g., good ductility, tensile and/or yield strength) and/or good fatigue properties. There is also a need for a method of processing such alloys to achieve both good tensile properties and good fatigue properties.

BRIEF SUMMARY OF THE DISCLOSURE

Various non-limiting embodiments disclosed herein related to methods of processing metastable β-titanium alloys. For example, one non-limiting embodiment provides a method of processing a metastable β-titanium alloy comprising greater than 10 weight percent molybdenum, the method comprising hot working the metastable β-titanium alloy, and direct aging the metastable β-titanium alloy, wherein direct aging comprises heating the metastable β-titanium alloy in the hot worked condition at an aging temperature ranging from greater than 850° F. to 1375° F. for a time sufficient to form α-phase precipitates within the metastable β-titanium alloy.

Another non-limiting embodiment provides a method of processing a metastable β-titanium alloy comprising greater than 10 weight percent molybdenum, the method comprising hot working a metastable β-titanium alloy and direct aging the metastable β-titanium alloy, wherein direct aging comprises heating the metastable β-titanium alloy in the hot worked condition at a first aging temperature below the β-transus temperature of the metastable β-titanium alloy for a time sufficient to form and at least partially coarsen at least one α-phase precipitate in at least a portion of the metastable β-titanium alloy; and subsequently heating the metastable β-titanium alloy at a second aging temperature that is lower than the first aging temperature for a time sufficient to form at least one additional α-phase precipitate in at least a portion of the metastable β-titanium alloy.

Another non-limiting embodiment provides a method of processing a metastable β-titanium alloy comprising greater than 10 weight percent molybdenum, the method comprising hot working a metastable β-titanium alloy and direct aging the metastable β-titanium alloy, wherein direct aging comprises heating the metastable β-titanium alloy in the hot worked condition at a first aging temperature ranging from 1225° F. to 1375° F. for at least 0.5 hours, and subsequently heating the metastable β-titanium alloy at a second aging temperature ranging from 850° F. to 1000° F. for at least 0.5 hours.

Another non-limiting embodiment provides a method of processing a metastable β-titanium alloy comprising greater than 10 weight percent molybdenum, the method comprising hot working the metastable β-titanium alloy to a reduction in area of at least 95% by at least one of hot rolling and hot extruding the metastable β-titanium alloy; and direct aging the metastable β-titanium alloy by heating the metastable β-titanium alloy in the hot worked condition at an aging temperature below the β-transus temperature of metastable β-titanium alloy for a time sufficient to form α-phase precipitates in the metastable β-titanium alloy.

Another non-limiting embodiment provides a method of processing a binary β-titanium alloy comprising greater than 10 weight percent molybdenum, the method comprising hot working the binary β-titanium alloy and direct aging the binary β-titanium alloy by heating the β-titanium alloy in the hot worked condition at an aging temperature below the β-transus temperature of binary β-titanium alloy for a time sufficient to form α-phase precipitates within the binary β-titanium alloy, wherein after processing, the binary β-titanium alloy has a tensile strength of at least 150 ksi and an elongation of at least 12 percent.

Other non-limiting embodiments of the present invention relate to binary β-titanium alloys. For example, one non-limiting embodiment provides a binary β-titanium alloy comprising greater than 10 weight percent molybdenum, wherein the binary β-titanium alloy is processed by hot working the binary β-titanium alloy and direct aging the binary β-titanium alloy, wherein after processing, the binary β-titanium alloy has a tensile strength of at least 150 ksi and an elongation of at least 12 percent.

Another non-limiting embodiment provides a binary β-titanium alloy comprising greater than 10 weight percent molybdenum and having a tensile strength of at least 150 ksi and an elongation of at least 12 percent.

Other non-limiting embodiments disclosed herein relate to articles of manufacture made from binary β-titanium alloys. For example, one non-limiting embodiment provides an article of manufacture comprising a binary β-titanium alloy comprising greater than 10 weight percent molybdenum and having a tensile strength of at least 150 ksi and an elongation of at least 12 percent.

BRIEF DESCRIPTION OF THE SEVERAL VIEWS OF THE DRAWINGS

Various embodiments disclosed herein will be better understood when read in conjunction with the drawings, in which.

DETAILED DESCRIPTION OF EMBODIMENTS OF THE DISCLOSURE

Figure 1:
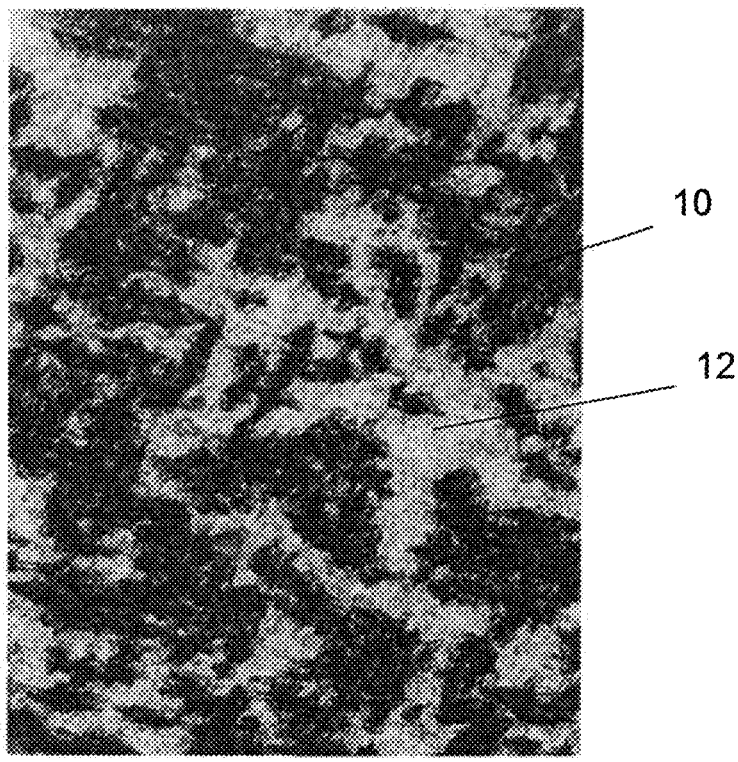
FIG. 1 is a micrograph of a metastable β-titanium alloy processed using single-step direct aging process according to various non-limiting embodiments disclosed herein.

As discussed above, embodiments of the present invention relate to metastable β-titanium alloys and methods of processing the same. More specifically, embodiments of the present invention relate to metastable β-titanium alloys, such as binary β-titanium alloys comprising greater than 10 weight percent molybdenum, and methods of processing such alloys to impart the alloys with desirable mechanical properties. As used herein, the term "metastable β-titanium alloys" means titanium alloys comprising sufficient amounts of β-stabilizing elements to retain an essentially 100% β-structure upon cooling from above the β-transus. Thus, metastable β-titanium alloys contain enough β-stabilizing elements to avoid passing through the martensite start (or "$M_s$") upon quenching, thereby avoiding the formation of martensite. Beta stabilizing elements (or β-stabilizers) are elements that are isomorphous with the body centered cubic ("bcc") β-titanium phase. Examples of β-stabilizers include, but are not limited to, zirconium, tantalum, vanadium, molybdenum, and niobium. See e.g., *Metal Handbook, Desk Edition,* 2$^{nd}$ *Ed.*, J. R. Davis ed., ASM International, Materials Park, Ohio (1998) at pages 575-588, which are specifically incorporated by reference herein.

As previously discussed, in the solution treated condition, metastable β-titanium alloys comprise a single-phase β-microstructure. However, by appropriate heat treatment at temperatures below the β-transus, α-phase titanium having a hexagonal close-packed crystal structure can be formed or precipitated in the β-phase microstructure. While the formation of α-phase within the β-phase microstructure can improve the tensile strength of the alloy, it also generally results in a marked decrease in the ductility of the alloy. However, as discussed below in more detail, the inventors have found that when metastable β-titanium alloys are processed according to the various non-limiting embodiments disclosed herein, a metastable β-titanium alloy having both desirable tensile strength and ductility can be formed.

Metastable β-titanium alloys that are suitable for use in conjunction with the methods according to various non-limiting embodiments disclosed herein include, but are not limited to, metastable β-titanium alloys comprising greater than 10 weight percent molybdenum. Other metastable β-titanium alloys that are suitable for use in conjunction with the methods according to various non-limiting embodiments disclosed herein include, without limitation, metastable β-titanium alloys comprising from 11 weight percent molybdenum to 18 weight percent molybdenum. According to certain non-limiting embodiments, the metastable β-titanium alloy comprises at least 14 weight percent molybdenum, and more specifically, comprises from 14 weight percent to 16 weight percent molybdenum. Further, in addition to molybdenum, the metastable β-titanium alloys according to various non-limiting embodiments disclosed herein can comprise at least one other β-stabilizing element, such as zirconium, tantalum, vanadium, molybdenum, and niobium.

Further, according various non-limiting embodiments disclosed herein, the metastable β-titanium alloy can be a binary β-titanium alloy comprising greater than 10 weight percent molybdenum, and more specifically, comprising from 14 weight percent to 16 weight percent molybdenum. According other non-limiting embodiments, the metastable β-titanium alloy is a binary β-titanium alloy comprising about 15 weight percent molybdenum. As used herein the term "binary β-titanium alloy" means a metastable β-titanium alloy that comprises two primary alloying elements. However, it will be appreciated by those skilled in the art that, in addition to the two primary alloying elements, binary alloy systems can comprise minor or impurity amounts of other elements or compounds that do not substantially change the thermodynamic equilibrium behavior of the system.

The metastable β-titanium alloys according to various non-limiting embodiments disclosed herein can be produced by any method generally known in the art for producing metastable β-titanium alloys. For example and without limitation, the metastable β-titanium alloy can be produced by a process comprising at least one of plasma arc cold hearth melting, vacuum arc remelting, and electron beam melting. Generally speaking, the plasma arc cold hearth melting process involves melting input stock that is either in the form of pressed compacts (called "pucks") formulated with virgin raw material, bulk solid revert (i.e., solid scrap metal), or a combination of both in a plasma arc cold hearth melting furnace (or "PAM" furnace). The resultant ingot can be rotary forged, press forged, or press forged and subsequently rotary forged to an intermediate size prior to hot working.

For example, according to certain non-limiting embodiments disclosed herein, the β-titanium alloy can be produced by plasma arc cold hearth melting. According to other non-limiting embodiments, the metastable β-titanium alloy can be produced by plasma arc cold hearth melting and vacuum arc remelting. More specifically, the β-titanium alloy can be produced by plasma arc cold hearth melting in a primary melting operation, and subsequently vacuum arc remelted in a secondary melting operation.

Methods of processing metastable β-titanium alloys according to various non-limiting embodiments of the present invention will now be discussed. One non-limiting embodiment disclosed herein provides a method of processing a metastable β-titanium alloy comprising greater than 10 weight percent molybdenum, the method comprising hot working the metastable β-titanium alloy to a reduction in area of at least 95% by at least one of hot rolling and hot extruding the metastable β-titanium alloy, and direct aging the metastable β-titanium alloy by heating the metastable β-titanium alloy in the hot worked condition at an aging temperature below the β-transus temperature of metastable β-titanium alloy for a time sufficient to form α-phase in the metastable β-titanium alloy.

Although not meant to be bound by any particular theory, hot working the metastable β-titanium alloy prior to aging in accordance with various non-limiting embodiments disclosed herein is believed by the inventors to be advantageous in increasing the level of work in the alloy and decreasing the grain size of the alloy. Generally speaking, the metastable β-titanium alloy can be hot worked to any percent reduction required to achieve the desired configuration of the alloy, as well as to impart a desired level of work into the β-phase microstructure. As discussed above, in one non-limiting embodiment the metastable β-titanium alloy can be hot worked to a reduction in area of at least 95%. According to another non-limiting embodiment the metastable β-titanium alloy can be hot worked to a reduction in area of at least 98%. According to still another non-limiting embodiment, the metastable β-titanium alloy can be hot worked to a reduction in area of 99%. According to still other non-limiting embodiments, the metastable β-titanium alloy can be hot worked to a reduction in area of at least 75%.

Further, as discussed above, according to one non-limiting embodiment, hot working the metastable β-titanium alloy can comprise at least one of hot rolling and hot extruding the metastable β-titanium alloy. For example, according to various non-limiting embodiments disclosed herein, hot working the metastable β-titanium alloy can comprise hot rolling the metastable β-titanium alloy at a roll temperature ranging from greater than 1100° F. to 1725° F. Further, according to other non-limiting embodiments disclosed herein hot working the metastable β-titanium alloy can comprise hot extruding the metastable β-titanium alloy at a temperature ranging from 1000° F. to 2000° F. For example, hot extruding the metastable β-titanium alloy can comprise welding a protective can made from stainless steel, titanium or other alloy or material around the metastable β-titanium alloy to be extruded (or "mult"), heating the canned mult to a selected extrusion temperature, and extruding the entire piece through an extrusion die. Other methods of hot working the metastable β-titanium alloy include, without limitation, those methods known in the art for hot working metastable β-titanium alloys—such as, hot forging or hot drawing.

As discussed above, after hot working the metastable β-titanium alloy, the alloy is direct aged. As used herein the term "aging" means heating the alloy at a temperature below the β-transus temperature for a period of time sufficient to form α-phase precipitates within the β-phase microstructure. Further, as used herein, the term "direct aging" means aging an alloy that has been hot worked without solution treating the alloy prior to aging.

According to various non-limiting embodiments, direct aging the metastable β-titanium alloy can comprise a single-step direct aging process wherein the metastable β-titanium alloy is heated in the hot worked condition at an aging temperature below the β-transus temperature of the metastable β-titanium alloy for a time sufficient to form α-phase precipitates in the metastable β-titanium alloy. For example, although not limiting herein, according to various non-limiting embodiments, the aging temperature can range from 850° F. to 1375° F., and can further range from greater than 900° F. to 1200° F. According to other non-limiting embodiments, the aging temperature can range from 925° F. to 1150° F. and can still further range from 950° F. to 1100° F.

One specific non-limiting embodiment provides a method of processing a β-titanium alloy comprising greater than 10 weight percent molybdenum, the method comprising hot working the metastable β-titanium alloy and direct aging the metastable β-titanium alloy, wherein direct aging comprises heating the metastable β-titanium alloy in the hot worked condition at an aging temperature ranging from 850° F. to 1375° F. for a time sufficient to form α-phase precipitates in the metastable β-titanium alloy.

As discussed above, according to various non-limiting embodiments, direct aging the metastable β-titanium alloy comprises heating the metastable β-titanium alloy in the hot worked condition for a time sufficient to form α-phase precipitates in the metastable β-titanium alloy. It will be appreciated by those skilled in the art that the precise time required to precipitate the α-phase precipitates in the metastable β-titanium alloy will depend upon several factors, such as, but not limited to, the size and configuration of the alloy, and the aging temperature(s) employed. For example, although not limiting herein, according to one non-limiting embodiment, direct aging the metastable β-titanium alloy can comprise heating the metastable β-titanium alloy at a temperature ranging from 850° F. to 1375° F. for at least 0.5 hours. According to another non-limiting embodiment, direct aging can comprise heating the metastable β-titanium alloy at a temperature ranging from 850° F. to 1375° F. for at least 2 hours. According to still another non-limiting embodiment, direct aging can comprise heating the metastable β-titanium alloy at a temperature ranging from 850° F. to 1375° F. for at least 4 hours. According to another non-limiting embodiment, direct aging can comprise heating the metastable β-titanium alloy at a temperature ranging from 850° F. to 1375° F. for 0.5 to 5 hours.

After processing the metastable β-titanium alloy in accordance with various non-limiting embodiments disclosed herein, the metastable β-titanium alloy can have a tensile strength of at least 150 ksi, at least 170 ksi, at least 180 ksi or greater. Further, after processing the metastable β-titanium alloy in accordance with various non-limiting embodiment disclosed herein, the metastable β-titanium alloy can have an elongation of at least 10 percent, at least 12 percent, at least 15 percent, at least 17 percent and further can have an elongation of at least 20 percent.

As previously discussed, in the solution treated or β-annealed condition Ti-15Mo β-titanium alloys generally have elongations around 25% and tensile strengths around 110 ksi. Further, as previously discussed, while aging a solution treated Ti-15Mo alloy to form α-phase precipitates within the β-phase microstructure can result in an increase in the tensile strength of the alloy, aging generally decreases the ductility of the alloy. However, by direct aging metastable β-titanium alloys, such as Ti-15Mo, after hot working according to various non-limiting embodiments described herein, tensile strengths of at least 150 ksi and elongations of at least 12 percent can be achieved.

Figure 2:
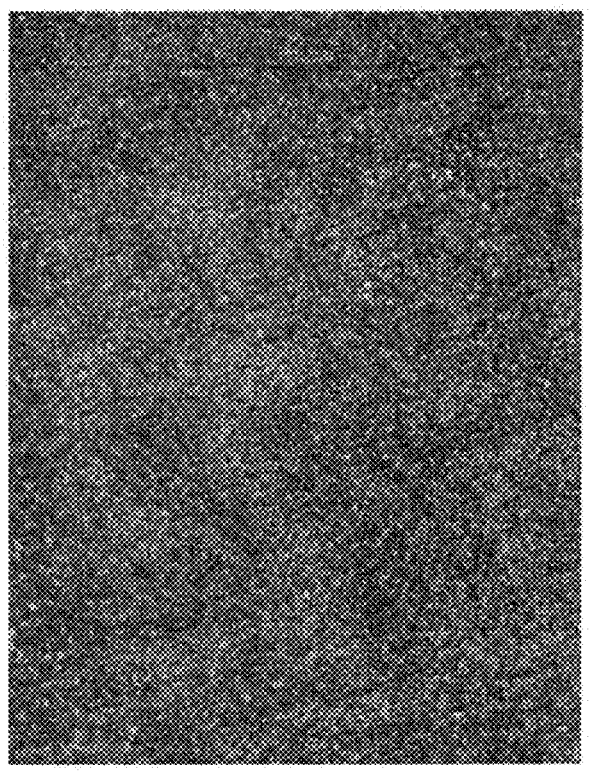
FIG. 2 is a micrograph of a metastable β-titanium alloy processed using two-step direct aging process according to various non-limiting embodiments disclosed herein.

Although not meant to be bound by any particular theory, it is contemplated that by direct aging the metastable β-titanium alloy after hot working α-phase can be more uniformly formed or precipitated in the β-phase microstructure than if the alloy is solution treated prior to aging, thereby resulting in improved mechanical properties. For example, FIGS. 1 and 2 show the microstructures of binary β-titanium alloys comprising about 15 weight percent molybdenum (i.e., Ti-15Mo) processed by a direct aging the alloy in the hot worked condition according to various non-limiting embodiments discussed herein. More specifically, FIG. 1 is a micrograph of a Ti-15Mo alloy that was hot worked and direct aged in a single-step direct aging process by hot rolling the alloy to a reduction in area of 99% and thereafter direct aging the alloy by heating the alloy in the hot worked condition at an aging temperature of about 950° F. for about 4 hours, followed by air cooling. As shown in FIG. 1, the microstructure includes both α-phase precipitates 10 and α-lean (e.g., precipitate-free or untransformed β-phase) regions 12.

FIG. 2 is a micrograph of a Ti-15Mo alloy that was processed by a two-step direct aging process according to various non-limiting embodiments disclosed herein below. More specifically, the Ti-15Mo alloy of FIG. 2 was hot rolled at a reduction in area of at least 99% and subsequently direct aged by heating the alloy in the hot worked condition at a first aging temperature of about 1275° F. for about 2 hours, followed by water quenching, and subsequently heating the alloy at a second aging temperature of about 900° F. for about 4 hours, followed by air cooling. As shown in FIG. 2, α-phase precipitates are generally uniformly distributed throughout the microstructure. Further, as discussed below in more detail, processing β-titanium alloys using a two-step direct aging process according to various non-limiting embodiments disclosed herein can be useful in producing β-titanium alloys having a microstructure with a uniform distribution of α-phase precipitates and essentially no untransformed (e.g., precipitate-free or α-lean) metastable phase regions.

As discussed above, other non-limiting embodiments disclosed herein provide a method of processing a metastable β-titanium alloy comprising greater than 10 weight percent molybdenum, wherein the method comprises hot working the metastable β-titanium alloy and direct aging the metastable β-titanium alloy in a two-step direct aging process in which the metastable β-titanium alloy is heated in the hot worked condition at a first aging temperature below the β-transus temperature and subsequently heated at a second aging temperature below the first aging temperature.

For example, one specific non-limiting embodiment provides a method of processing a metastable β-titanium alloy comprising greater than 10 weight percent molybdenum, the method comprising hot working a metastable β-titanium alloy and direct aging the metastable β-titanium alloy, wherein direct aging comprises heating the metastable β-titanium alloy in the hot worked condition at a first aging temperature below the β-transus temperature of the metastable β-titanium alloy for a time sufficient to form and at least partially coarsen at least one α-phase precipitate in at least a portion of the metastable β-titanium alloy and subsequently heating the metastable β-titanium alloy at a second aging temperature that is lower than the first aging temperature for a time sufficient to form at least one additional α-phase precipitate in at least a portion of the metastable β-titanium alloy. Further, according to this non-limiting embodiment, after direct aging, the metastable β-titanium alloy can have a microstructure comprising at least one coarse α-phase precipitate and at least one fine α-phase precipitate.

Additionally, according to various non-limiting embodiments disclosed herein, direct aging the metastable β-titanium alloy can comprise heating at the first aging temperature for a time sufficient to form and at least partially coarsen α-phase precipitates in at least a portion of the metastable phase regions of the alloy, and subsequently heating at the second aging temperature for a time sufficient to form α-phase precipitates in the majority of the remaining metastable phase regions. Further, according to various non-limiting embodiments disclosed herein, the metastable β-titanium alloy can be aged at the second aging temperature for a time sufficient to form additional α-phase precipitates in essentially all of the remaining metastable phase regions of the alloy. As used herein, the term "metastable phase regions" with respect to the metastable β-titanium alloys refers to phase regions within the microstructure that are not thermodynamically favored (i.e., metastable or unstable) at the aging temperature and include, without limitation, β-phase regions as well as ω-phase regions within the microstructure of the alloy. Further, as used herein with respect to the formation of α-phase precipitates in the metastable phase regions, the term "majority" means greater than 50% percent of the remaining metastable phase regions are transformed by the formation of α-phase precipitates, and the term "essentially all" means greater than 90% of the remaining metastable phase regions are transformed by the formation of α-phase precipitates.

Although not limiting herein, the inventors have observed that by direct aging the hot worked metastable β-titanium alloy by heating at a first aging temperature below the β-transus temperature and subsequently heating the metastable β-titanium alloy at a second aging temperature that is lower than the first aging temperature, a microstructure having a distribution of coarse and fine α-phase precipitates can be formed. Although not limiting herein, it is contemplated by the inventors that metastable β-titanium alloys that are processed to avoid the retention of untransformed (e.g., precipitate-free or α-lean) metastable phase regions within the microstructure may have improved fatigue resistance and/or stress corrosion cracking resistance as compared to metastable β-titanium alloys with such untransformed regions. Further, although not limiting herein, it is contemplated that by transforming essentially all of the metastable phase regions in the microstructure to coarse and fine α-phase precipitates, the resultant alloy can have a desirable combination of mechanical properties such as tensile strength and ductility. As used herein, the term "coarse" and "fine" with respect to the α-phase precipitates refers generally to the grain size of the precipitates, with coarse α-phase precipitates having a larger average grain size than fine α-phase precipitates.

According to various non-limiting embodiments disclosed herein, the first aging temperature can range from 1225° F. to 1375° F. and the second aging temperature can range from 850° F. to 1000° F. According to other non-limiting embodiments, the first aging temperature can range from greater than 1225° F. to less than 1375° F. According to still other non-limiting embodiments, the first aging temperature can range from 1250° F. to 1350° F., can further range from 1275° F. to 1325° F., and can still further range from 1275° F. to 1300° F.

Further, as discussed above, the metastable β-titanium alloy can be heated at the first aging temperature for a time sufficient to precipitate and at least partially coarsen α-phase precipitates in the metastable β-titanium alloy. It will be appreciated by those skilled in the art that the precise time required to precipitate and at least partially coarsen α-phase precipitates in the metastable β-titanium alloy will depend, in part, upon the size and configuration of the alloy, as well as the first aging temperature employed. According to various non-limiting embodiments disclosed herein, the β-titanium alloy can be heated at the first aging temperature for at least 0.5 hours. According to another non-limiting embodiment, the metastable β-titanium alloy can be heated at the first aging temperature for at least 2 hours. According to still other non-limiting embodiments, the metastable β-titanium alloy can be heated at the first aging temperature for a time ranging from 0.5 to 5 hours.

As discussed above, according to various non-limiting embodiments disclosed herein, the second aging temperature can range from 850° F. to 1000° F. According to other non-limiting embodiments, the second aging temperature can range from greater than 850° F. to 1000° F., can further range from 875° F. to 1000° F., and can still further range from 900° F. to 1000° F.

Additionally, as discussed above, the metastable β-titanium alloy can be heated at the second aging temperature for a time sufficient to form at least one additional α-phase precipitate in the metastable β-titanium alloy. While it will be appreciated by those skilled in the art that the exact time required to form such additional α-phase precipitates in the metastable β-titanium alloy will depend, in part, upon the size and configuration of the alloy as well as the second aging temperature employed, according to various non-limiting embodiments disclosed herein, the metastable β-titanium alloy can be heated at the second aging temperature for at least 0.5 hour. According to another non-limiting embodiment, the metastable β-titanium alloy can be heated at the second aging temperature for at least 2 hours. According to still other non-limiting embodiments, the metastable β-titanium alloy can be heated at the second aging temperature for a time raging from 0.5 to 5 hours.

After processing the metastable β-titanium alloy using a two-step direct aging process in accordance with various non-limiting embodiments disclosed herein, the metastable β-titanium alloy can have a tensile strength of at least 150 ksi, at least 170 ksi, at least 180 ksi or greater. Further, after processing the metastable β-titanium alloy in accordance with various non-limiting embodiment disclosed herein, the metastable β-titanium alloy can have an elongation of at least 10 percent, at least 12 percent, at least 15 percent, at least 17 percent, and further can have an elongation of at least 20 percent.

Still other non-limiting embodiments disclosed herein provide a method of processing a binary β-titanium alloy comprising greater than 10 weight percent molybdenum, the method comprising hot working the binary β-titanium alloy and direct aging the binary β-titanium alloy at a temperature below the β-transus temperature of the binary β-titanium alloy for a time sufficient to form α-phase precipitates in the binary β-titanium alloy; wherein after processing, the binary β-titanium alloy has a tensile strength of at least 150 ksi and an elongation of 10 percent or greater. For example, after processing the binary β-titanium alloy can have a tensile strength of at least 150 ksi and an elongation of at least 12 percent, at least 15 percent, or at least 20 percent. Further, although not limiting herein, according to this non-limiting embodiment, after processing, the binary β-titanium alloy can have a tensile strength ranging from 150 ksi to 180 ksi and an elongation ranging from 12 percent to 20 percent. For example, according to one non-limiting embodiment, after processing, the binary β-titanium alloy can have a tensile strength of at least 170 ksi and an elongation of at least 15 percent. According to another non-limiting embodiment, after processing, the binary β-titanium alloy can have a tensile strength of at least 180 ksi and an elongation of at least 17 percent.

Non-limiting methods of direct aging binary β-titanium alloys that can be used in conjunction with the above-mentioned non-limiting embodiment include those set forth above in detail. For example, although not limiting herein, according to the above-mentioned non-limiting embodiment, direct aging the binary β-titanium alloy can comprise heating the binary β-titanium alloy in the hot worked condition at an aging temperature ranging from 850° F. to 1375° F. for at least 2 hours. In another example, direct aging the binary β-titanium alloy can comprise heating the binary β-titanium alloy in the hot worked condition at a first aging temperature ranging from greater than 1225° F. to less than 1375° F. for at least 1 hour; and subsequently heating the binary β-titanium alloy at a second aging temperature ranging from greater than 850° F. to 1000° F. for at least 2 hours.

Other embodiments disclosed herein relate to binary β-titanium alloys comprising from greater than 10 weight percent molybdenum, and more particularly comprise from 14 weight percent to 16 weight percent molybdenum, that are made in accordance with the various non-limiting methods discussed above. For example, one non-limiting embodiment provides a binary β-titanium alloy comprising greater than 10 weight percent molybdenum, wherein the binary β-titanium alloy is processed by hot working the binary β-titanium alloy and direct aging the binary β-titanium alloy and wherein after processing, the binary titanium alloy has a tensile strength of at least 150 ksi and an elongation of at least 12 percent. Non-limiting methods of direct aging binary β-titanium alloys that can be used in conjunction with the above-mentioned non-limiting embodiment include those set forth above in detail.

Suitable non-limiting methods of hot working binary β-titanium alloys that can be used in connection with this and other non-limiting embodiments disclosed herein are set forth above. For example, according various non-limiting embodiments, hot working the binary β-titanium alloy can comprise at least one of hot rolling and hot extruding the binary β-titanium alloy. Further, although not limiting herein, the binary β-titanium alloy can be hot worked to a reduction in area ranging from 95% to 99% in accordance with various non-limiting embodiments disclosed herein.

Other non-limiting embodiments disclosed herein provide a binary β-titanium alloy comprising greater than 10 weight percent molybdenum, and more particularly comprising 14 weight percent to 16 weight percent molybdenum, and having a tensile strength of at least 150 ksi and an elongation of at least 12 percent. Further, according to this non-limiting embodiment, the binary β-titanium alloy can have an elongation of at least 15% or at least 20%. Non-limiting methods of making the binary β-titanium alloys according to this and other non-limiting embodiments disclosed herein are set forth above.

Another non-limiting embodiment provides a binary β-titanium alloy comprising greater than 10 weight percent, and more particularly comprising from 14 weight percent to 16 weight percent molybdenum, wherein the binary β-titanium alloy has a tensile strength ranging from 150 ksi to 180 ksi and an elongation ranging from 12 percent to 20 percent. For example, according to one non-limiting embodiment, the binary β-titanium alloy can have a tensile strength of at least 170 ksi and an elongation of at least 15 percent. According to another non-limiting embodiment, the binary β-titanium alloy can have a tensile strength of at least 180 ksi and an elongation of at least 17 percent.

Further the metastable β-titanium alloys processed according to various non-limiting embodiments disclosed herein can have rotating beam fatigue strengths of at least 550 MPa (about 80 ksi). As used herein the term "rotating beam fatigue strength" means the maximum cyclical stress that a material can withstand for $10^7$ cycles before failure occurs in a rotating beam fatigue test when tested at a frequency of 50 Hertz and R=−1. For example, one non-limiting embodiment provides a binary β-titanium alloy comprising greater than 10 weight percent and having a tensile strength of at least 150 ksi, an elongation of at least 12 percent, and a rotating beam fatigue strength of at least 550 MPa. Another non-limiting embodiment provides a binary β-titanium alloy comprising greater than 10 weight percent and having a tensile strength of at least 150 ksi, an elongation of at least 12 percent, and a rotating beam fatigue strength of at least 650 MPa (about 94 ksi).

Other embodiments disclosed herein are directed toward articles of manufacture comprising binary β-titanium-molybdenum alloys according to the various non-limiting embodiments set forth above. Non-limiting examples of articles of manufacture that can be formed from the binary β-titanium alloys disclosed herein can be selected from biomedical devices, such as, but not limited to femoral hip stems (or hip stems), femoral heads (modular balls), bone screws, cannulated screws (i.e., hollow screws), tibial trays (knee components), dental implants, and intermedullary nails; automotive components, such as, but not limited to valve lifters, retainers, tie rods, suspension springs, fasteners, and screws etc.; aerospace components, such as, but not limited to springs, fasteners, and components for satellite and other space applications; chemical processing components, such as, but not limited to valve bodies, pump casings, pump impellers, and vessel and pipe flanges; nautical components such as, but not limited to fasteners, screws, hatch covers, clips and connectors, ladders and handrails, wire, cable and other components for use in corrosive environments.

Various non-limiting embodiments of the present invention will now be illustrated by the following non-limiting examples.

EXAMPLE 1

Allvac® Ti-15Mo Beta Titanium alloy, which is commercially available from ATI Allvac of Monroe, N.C., was hot rolled at a percent reduction in area of 99% at rolling temperatures ranging from about 1200° F. to about 1650° F. Samples of the hot rolled material were then direct aged using either a single-step or a two-step direct aging process as indicated below in Table I. Comparative samples were also obtained from the hot rolled material. As indicated in Table 1, however, the comparative samples were not direct aged after hot rolling.

TABLE I

| Sample Number | First Aging Temp. (° F.) | First Aging Time (Hours) | Second Aging Temp. (° F.) | Second Aging Time (Hours) |
|---|---|---|---|---|
| Comparative | NA | NA | NA | NA |
| 1 | 850 | 4 | NA | NA |
| 2 | 900 | 4 | NA | NA |
| 3 | 950 | 4 | NA | NA |
| 4 | 1275 | 2 | NA | NA |
| 5 | 1325 | 2 | NA | NA |
| 6 | 1375 | 2 | NA | NA |
| 7 | 1225 | 2 | 850 | 4 |
| 8 | 1225 | 2 | 900 | 4 |
| 9 | 1275 | 2 | 850 | 4 |
| 10 | 1275 | 2 | 900 | 4 |
| 11 | 1300 | 2 | 900 | 4 |
| 12 | 1325 | 2 | 850 | 4 |
| 13 | 1325 | 2 | 900 | 4 |
| 14 | 1325 | 2 | 950 | 4 |
| 15 | 1350 | 2 | 900 | 4 |
| 16 | 1375 | 2 | 850 | 4 |
| 17 | 1375 | 2 | 900 | 4 |

After processing according to Table I, samples were tensile tested from both the lead and the trail of the coil according to ASTM E21. The tensile testing results are set forth in Table II below, wherein the tabled values are averages of the two test results obtained for each sample (i.e., an average of the values obtained from the lead end sample and the trail end sample).

TABLE II

| Sample Number | UTS (ksi) | 0.2% YS (ksi) | Elong. (%) | ROA (%) |
|---|---|---|---|---|
| Comparative | 137.6 | 121.9 | 18.5 | 77.5 |
| 1 | 229.4 | 226.9 | 3.0 | 11.0 |
| 2 | 213.8 | 209.3 | 5.0 | 17.5 |
| 3 | 179.4 | 170.2 | 19.0 | 67.0 |
| 4 | 120.7 | 116.8 | 24.5 | 79.0 |
| 5 | 125.8 | 121.7 | 21.5 | 78.0 |
| 6 | 132.8 | 125.3 | 19.0 | 74.5 |
| 7 | 135.3 | 126.9 | 22.0 | 78.8 |
| 8 | 141.2 | 133.3 | 22.0 | 78.9 |
| 9 | 188.8 | 182.5 | 10.0 | 26.9 |
| 10 | 169.0 | 161.6 | 17.3 | 53.2 |
| 11 | 180.3 | 172.2 | 16.5 | 70.7 |
| 12 | 209.7 | 205.5 | 7.5 | 14.3 |
| 13 | 192.9 | 184.9 | 11.5 | 45.4 |
| 14 | 159.4 | 144.5 | 20.0 | 74.3 |
| 15 | 200.2 | 196.3 | 9.5 | 34.9 |
| 16 | 224.7 | 221.7 | 4.5 | 14.4 |
| 17 | 206.8 | 202.3 | 8.3 | 26.5 |

As can be seen from the results in Table II, by processing the Ti-15Mo β-titanium alloys as described above and in accordance with various non-limiting embodiments disclosed herein, Ti-15Mo alloys having advantageous mechanical properties that can be used in a variety of applications can be produced.

EXAMPLE 2

A Ti-15Mo ingot was melted, forged and rolled at ATI Allvac. Titanium sponge was blended with pure molybdenum powder to produce compacts for melting a 1360 kg ingot. A plasma cold hearth melting process was used to maintain a shallow melt pool and homogeneity during the primary melt. The plasma melted primary ingot measured 430 mm in diameter. A secondary ingot was subsequently melted to 530 mm in diameter by VAR. The results from chemical analysis of the secondary ingot are presented along with the composition limits set by ASTM F 2066 (Table III). Two values are given for the product analysis when differences were detected between the composition of the top and bottom of the secondary ingot. The β-transus of the ingot was approximately 790° C. (about 1454° F.).

TABLE III

| Element | ASTM F 2066 Limit, weight % | Ti—15%Mo |
|---|---|---|
| Nitrogen | 0.05 | 0.001 to 0.002 |
| Carbon | 0.10 | 0.006 |
| Hydrogen | 0.015 | 0.0017 |
| Iron | 0.10 | 0.02 |
| Oxygen | 0.20 | 0.15 to 0.16 |
| Molybdenum | 14 to 16 | 14.82 to 15.20 |
| Titanium | balance | balance |

The double melted, 530 mm diameter Ti-15Mo ingot was rotary forged to 100 mm diameter billet using a multi-step process. The final reduction step of this process was conducted above the β-transus temperature, and the resultant microstructure was an equiaxed, β-annealed condition. The 100 mm billet material was subsequently processed into bars using four different processing conditions (A-D) as discussed below. Processing conditions A-C, involved hot working and direct aging, while processing condition D, involved hot working followed by a β-solution treatment.

For processing conditions A and D, the 100 mm billet was hot rolled at temperature of approximately 1575° F. (i.e., above the β-transus temperature of the Ti-15Mo alloy) to form a 25 mm diameter round bar (approximately a 94% reduction in area) using a continuous rolling mill. For processing condition B, the 100 mm billet was prepared by hot rolling at a temperature of approximately 1500° F. (i.e., above the β-transus temperature of the Ti-15Mo alloy) to a form a 1"×3" (25 mm×75 mm) rectangular bar (approximately a 76% reduction in area) using a hand rolling mill. For processing condition C, the 100 mm billet was prepared as discussed above for processing condition B, however, the hot rolling temperature was approximately 1200° F. (i.e., below the β-transus temperature of the Ti-15Mo alloy).

After hot working as discussed above, the materials were processed and tested as discussed below by Zimmer, Inc. See also Brian Marquardt & Ravi Shetty "*Beta Titanium Alloy Processed for High Strength Orthopaedic Applications*" to be published in *Symposium on Titanium, Niobium, Zirconium, and Tantalum for Medical and Surgical Applications*, JAI 9012, Vol. XX, No. X; and Brian Marquardt, "*Characterization of Ti-15Mo for Orthopaedic Applications*" to be published in *β-Titanium Alloys of the 00's: Corrosion and Biomedical*, Proceedings of the TMS Annual Meeting (2005).

In processing condition A, B and C, after hot rolling, the hot rolled materials were aged in a vacuum furnace at a first aging temperature high in the alpha/beta phase field and subsequently cooled using a fan assisted argon gas quench. Thereafter, the materials were aged at second aging temperature of 480° C. (about 896° F.) for 4 hours. In processing condition D, after hot rolling, the hot rolled material was β-solution treated at a temperature of 810° C. for 1 hour in an air furnace, followed by water quenching.

After processing, samples of materials processed using conditions A, B, C, and D were observed using an optical microscope. The material processed using condition A was observed to have banded microstructure with regions of equiaxed prior beta grains and globular alpha grains separated by regions of recovered beta grains and elongated alpha. The microstructure of the material processed using condition B showed little to no evidence of recrystallization. The alpha phase was elongated in some areas but it often appeared in a partially globularized form along variants of the prior beta grains. The material processed using condition C had a fully recrystallized and uniformly refined microstructure, wherein the recrystallized prior beta grains and globular alpha were roughly equivalent in size to the recrystallized regions in the banded structure of the material processed using condition A. The average prior beta grain size was approximately 2 μm while the globular alpha was typically 1 μm or less. The material processed using condition D was observed to have an equiaxed beta grain structure 'free' of alpha phase, wherein the beta grain size was approximately 100 μm.

Smooth tensile tests were conducted on specimen obtained from materials processed using conditions A, B, C, and D in accordance to ASTM E-8 at a strain rate of 0.005 per minute through the 0.2% yield strength and a head rate of 1.3 mm per minute to failure. The smooth tensile specimens were machined and tested at Metcut Research. The smooth test specimen configuration had nominal gage dimensions of 6.35 mm diameter by 34.5 mm length. The results of the tensile tests are shown below in Table IV.

Figure 3:
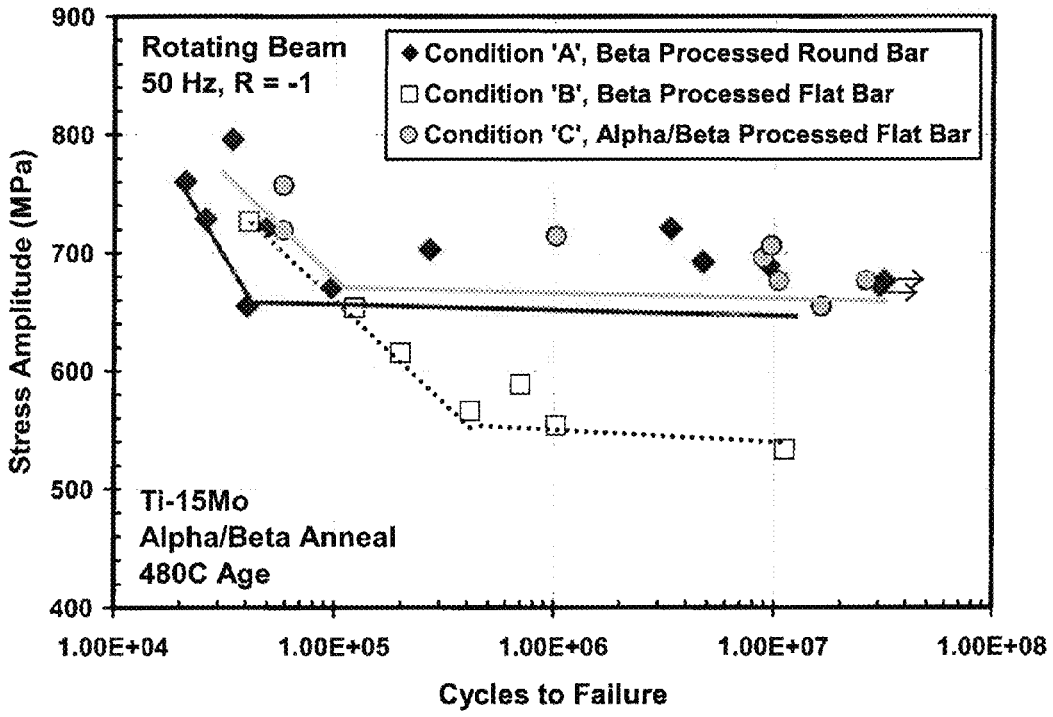
FIG. 3 is a plot of stress amplitude vs. cycles to failure for a Ti-15% Mo alloy processed according to various non-limiting embodiments disclosed herein.

Rotating beam fatigue testing were also conducted on specimen obtained from materials processed using conditions A, B and C. The rotating beam fatigue specimen were machined at Metcut Research and tested at Zimmer, Inc. using a Model RBF 200 made by Fatigue Dynamics of Dearborn, Mich. The specimen configuration had a nominal gage diameter of 4.76 mm. The R ratio of the test was −1 and the frequency was 50 Hertz. The results of the rotating beam fatigue tests are shown in FIG. 3.

TABLE IV

| Processing Condition | UTS MPa | 0.2% YS MPa | Elong. % | RA % |
|---|---|---|---|---|
| A | 1280 | 1210 | 14 | 59 |
| B | 1290 | 1240 | 9 | 32 |
| C | 1320 | 1290 | 9 | 32 |
| D | 770 | 610 | 38 | 80 |

As can be seen from the data in Table IV, the materials processed by hot working and direct aging (i.e., processing conditions A-C), had UTS values at or above 1280 MPa (about 186 ksi), 0.2% YS values at or above 1210 MPa (about 175 ksi), and elongations ranging from 9-14%. As expected, the material processed using processing condition D (i.e., hot working followed by β-solution treatment) had lower UTS and 2% YS than the direct aged materials values but higher elongations.

As can be seen from FIG. 3, the materials processed using conditions A and C had rotating beam fatigue strengths greater than about 600 MPa, and the material processed using condition B has a rotating beam fatigue strength greater than about 500 MPa.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, the present invention is not limited to the particular embodiments disclosed, but is intended to cover modifications that are within the spirit and scope of the invention as defined by the appended claims.

We claim:

1. A metastable β-titanium alloy consisting of:
titanium;
greater than 10 weight percent molybdenum; and
incidental impurities;
the metastable β-titanium alloy having a tensile strength of at least 150 ksi, an elongation of at least 12 percent, and a microstructure comprising a uniform distribution of α-phase precipitates in metastable phase regions of the metastable β-titanium alloy;
wherein the α-phase precipitates comprise coarse grain size α-phase precipitates and fine grain size α-phase precipitates, and wherein an average grain size of the coarse grain size α-phase precipitates is larger than an average grain size of the fine grain size α-phase precipitates.

2. The metastable β-titanium alloy of claim 1, wherein the metastable β-titanium alloy has a tensile strength of 150 ksi to 180 ksi and an elongation of 12 percent to 20 percent.

3. The metastable β-titanium alloy of claim 1, wherein the metastable β-titanium alloy has a rotating beam fatigue strength of at least 650 MPa.

4. The metastable β-titanium alloy of claim 1, wherein the metastable β-titanium alloy consists of titanium, at least 14 weight percent molybdenum, and incidental impurities.

5. The metastable β-titanium alloy of claim 4, wherein the metastable β-titanium alloy has a tensile strength of 150 ksi to 180 ksi and an elongation of 12 percent to 20 percent.

6. The metastable β-titanium alloy of claim 4, wherein the metastable β-titanium alloy has a rotating beam fatigue strength of at least 650 MPa.

7. The metastable β-titanium alloy of claim 4, wherein the metastable β-titanium alloy has a tensile strength of at least 180 ksi and an elongation of at least 17 percent.

8. An article of manufacture comprising:
a metastable β-titanium alloy consisting of titanium, greater than 10 weight percent molybdenum, and incidental impurities, the metastable β-titanium alloy having a tensile strength of at least 150 ksi, an elongation of at least 12 percent, and a microstructure comprising a uniform distribution of α-phase precipitates in metastable phase regions of the metastable β-titanium alloy, wherein the α-phase precipitates comprise coarse grain size α-phase precipitates and fine grain size α-phase precipitates, and wherein an average grain size of the coarse grain size α-phase precipitates is larger than an average grain size of the fine grain size α-phase precipitates.

9. The article of manufacture of claim 8, wherein the article of manufacture is selected from a biomedical component, an automotive component, an aerospace component, a chemical processing component, and a nautical component.

10. The article of manufacture of claim 8, wherein the article of manufacture is selected from a hip stem, a femoral hip stem, a femoral head, a modular ball, a bone screw, a cannulated screw, a hollow screw, a tibial tray, a knee component, a dental implant, and an intermedullary nail.

11. The article of manufacture of claim 8, where the article of manufacture is selected from a wire and a cable.

12. The article of manufacture of claim 8, wherein the metastable β-titanium alloy consists of titanium, at least 14 weight percent molybdenum, and incidental impurities.

13. The article of manufacture of claim 12, wherein the article of manufacture is selected from a biomedical component, an automotive component, an aerospace component, a chemical processing component, and a nautical component.

14. The article of manufacture of claim 12, wherein the article of manufacture is selected from a biomedical component comprising at least one of a hip stem, a femoral hip stem, a femoral head, a modular ball, a bone screw, a cannulated screw, a hollow screw, a tibial tray, a knee component, a dental implant, and an intermedullary nail.

15. The article of manufacture of claim 12, where the article of manufacture is selected from a wire and a cable.

16. A metastable β-titanium alloy consisting of:
titanium;
at least 14 weight percent molybdenum; and
incidental impurities;
the metastable β-titanium alloy having a tensile strength of at least 180 ksi, an elongation of at least 17 percent, and a microstructure comprising a uniform distribution of α-phase precipitates in metastable phase regions of the metastable β-titanium alloy.

17. The metastable β-titanium alloy of claim 16, wherein the metastable β-titanium alloy has a rotating beam fatigue strength of at least 650 MPa.

18. The metastable β-titanium alloy of claim 16, wherein the metastable β-titanium alloy has an elongation of 17 percent to 20 percent.

19. An article of manufacture comprising:
a metastable β-titanium alloy consisting of titanium, at least 14 weight percent molybdenum, and incidental impurities, the metastable β-titanium alloy having a tensile strength of at least 180 ksi, an elongation of at least 17 percent, and a microstructure comprising a uniform distribution of α-phase precipitates in metastable phase regions of the metastable β-titanium alloy.

20. The article of manufacture of claim 19, wherein the article of manufacture is selected from a biomedical component, an automotive component, an aerospace component, a chemical processing component, and a nautical component.

21. The article of manufacture of claim 19, wherein the article of manufacture is selected from a hip stem, a femoral hip stem, a femoral head, a modular ball, a bone screw, a cannulated screw, a hollow screw, a tibial tray, a knee component, a dental implant, and an intermedullary nail.

22. The article of manufacture of claim 19, wherein the article of manufacture is selected from a wire and a cable.

23. The article of manufacture of claim 19, wherein the α-phase precipitates comprise coarse grain size α-phase precipitates and fine grain size α-phase precipitates, and wherein an average grain size of the coarse grain size α-phase precipitates is larger than an average grain size of the fine grain size α-phase precipitates.

24. The article of manufacture of claim 23, wherein the article of manufacture is selected from a wire and a cable.

25. An article of manufacture comprising:
a metastable β-titanium alloy consisting of titanium, greater than 10 weight percent molybdenum, and incidental impurities, the metastable β-titanium alloy having a tensile strength of at least 150 ksi, an elongation of at least 12 percent, and a microstructure comprising a uniform distribution of α-phase precipitates in metastable phase regions of the metastable β-titanium alloy, wherein the article of manufacture is selected from a wire and a cable.

26. The article of manufacture of claim 25, wherein the metastable β-titanium alloy consists of titanium, at least 14 weight percent molybdenum, and incidental impurities.

* * * * *